United States Patent [19]

Schricker

[11] Patent Number: 5,001,982

[45] Date of Patent: Mar. 26, 1991

[54] ANTI-ARMOR WEAPON

[75] Inventor: Don Schricker, Blountville, Tenn.

[73] Assignee: General Dynamics Corp., Pomona Division, Pomona, Calif.

[21] Appl. No.: 375,937

[22] Filed: Jun. 26, 1989

Related U.S. Application Data

[63] Continuation-in-part of Ser. No. 212,450, Jun. 28, 1988, abandoned.

[51] Int. Cl.[5] ..... F42B 12/04

[52] U.S. Cl. ..... 102/380; 102/518

[58] Field of Search ..... 89/1.818; 102/211, 212, 102/213, 214, 374, 379, 380, 517, 518, 519

[56] References Cited

U.S. PATENT DOCUMENTS

| | | | |
|---|---|---|---|
| 3,561,362 | 2/1971 | Black et al. | 102/374 |
| 3,566,793 | 9/1968 | Kruzell | 102/49.3 |
| 3,935,817 | 2/1976 | Riparbelli | 102/52 |
| 4,198,896 | 4/1980 | Lamic et al. | 89/1.818 |
| 4,441,237 | 4/1984 | Kim et al. | 29/1.2 |
| 4,597,333 | 7/1986 | Böcker et al. | 102/518 |
| 4,706,569 | 11/1987 | Wallow et al. | 102/518 |

FOREIGN PATENT DOCUMENTS

| | | |
|---|---|---|
| 2500089 | 1/1975 | Fed. Rep. of Germany . |
| 1209802 | 1/1948 | France . |
| 1413030 | 11/1964 | France . |
| 1459597 | 12/1965 | France . |
| 2274016 | 6/1975 | France . |
| 2110799 | 12/1979 | United Kingdom . |

*Primary Examiner*—Stephen C. Bentley

*Attorney, Agent, or Firm*—Neil Martin; Leo R. Carroll

[57] ABSTRACT

An anti-armor weapon comprises an outer casing in which a non-explosive, armor-penetrating device, suitably a solid rod of heavy, high density metal or metal composite, is mounted. The penetrating device is mounted in a forward portion of the casing while a launch population device is mounted at the rear end for launching the weapon from a launch tube or firing barrel at a first, subsonic launch speed. A second, boost propulsion device is mounted in the casing adjacent the penetrating device for accelerating the weapon to a second, faster speed sufficient for the penetrating device to penetrate a target, and is associated with an igniter for actuating the boost propulsion device. A sensor is provided within the missile for sensing when the weapon is a predetermined distance from the target and subsequently actuating the igniter.

8 Claims, 1 Drawing Sheet

ANTI-ARMOR WEAPON

CROSS-REFERENCE TO RELATED APPLICATIONS

This application is a continuation-in-part of application Ser. No. 07/212,450, filed June 28, 1988 now abandoned.

BACKGROUND OF THE INVENTION

The present invention relates generally to anti-armor weapons for firing from a launch tube which may be shoulder held or mounted on a pedestal on the ground, on a surface vehicle, or on an aircraft.

Current light anti-armor weapons of this type are designed to be used at short ranges for final defense against tanks and other armored vehicles, and utilize shaped explosive charge warheads as the armor penetrating mechanism. One known weapon of this type is the Viper. Advances in armor technology, such as applique armor or composite armors, have severely reduced the effectiveness of such weapons. Another problem is that the warheads are energy limited and require extreme firing precision in order to be effective. Also, the presence of the explosive charge in the weapon results in a significant risk to the personnel firing the weapon or in the vicinity.

U.S. Pat. No. 4,519,315 of Arszman describes a shoulder fired weapon of this type, in which the explosive warhead must be delivered accurately to a position above the target before being fired.

Another known weapon in use for tank and artillery cannon shells is the so called "Kinetic Energy" penetrator. This consists of a non-explosive penetrator which is fired at a target at sufficient speed to penetrate and damage or destroy the target. In practice, such weapons are fired at hypersonic velocities of 3 to 4 Km/sec. This means that the launch tube or assembly must be relatively large and complex.

SUMMARY OF THE INVENTION

It is an object of the present invention to provide an improved anti-armor weapon.

According to the present invention, an anti-armor weapon is provided which comprises an outer casing, a non-explosive armor penetrator mounted at the forward end of the casing, a launch propulsion device mounted at the rear end of the casing for launching the weapon from a launch tube at a first, subsonic launch speed, and a boost propulsion device mounted in the casing with the launch propulsion device and the penetrator for accelerating the weapon to a second, faster speed sufficient for the penetrator to penetrate an armored target. A sensor is provided for determination of when the weapon is at a predetermined distance from the target, and for later actuating an igniter to fire the boost propulsion device.

In practice, the weapon will preferably be launched at around 300 m/sec, and will be accelerated to a terminal velocity over 3 Km/sec when it is relatively near to the target. The penetrator is suitably a solid rod of heavy metal, such as tungsten or the like or a metal composite following current technological advances of this type, with a pointed forward end. The launch propulsion device or motor may separate from the remainder of the weapon on firing of the boost propulsion device.

The launch motor may be equivalent to the launch motors used in shoulder fired weapons having explosive shaped charges, such as the Viper or Viper Variant. The launch tube used may also be similar to existing launchers for other anti-armor weapons, but may be made longer if necessary to accommodate the additional length of the armor penetrator rod. The boost propulsion device is preferably a very rapid burning rocket motor for accelerating the weapon to any desired higher or "hypersonic" speed.

This weapon therefore allows firing of a non-explosive, kinetic energy penetrator safely and easily, allowing a more effective final defense against armored tanks and the like having armor which will normally defeat explosive effects weapons. It will be safer to fire than explosive weapons, since it contains no explosive, and since the more dangerous rocket motor fuel is ignited at a distance.

BRIEF DESCRIPTION OF THE DRAWINGS

The present invention will be better understood from the following detailed description of a preferred embodiment of the invention, taken in conjunction with the accompanying drawings, in which like reference numerals refer to like parts and in which:

FIG. 1 is a diagrammatic illustration of the operation sequence of a light anti-armor weapon according to a preferred embodiment of the present invention;

FIG. 2 is a cross-sectional view of the weapon; and

DESCRIPTION OF THE PREFERRED EMBODIMENT

Figure 3:
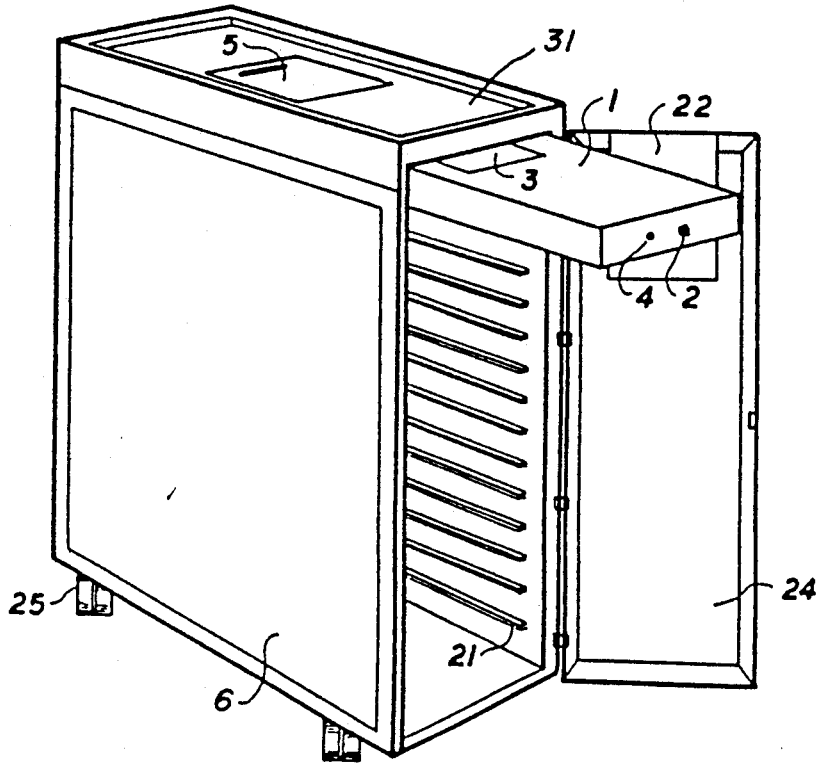
FIG. 3 is a diagrammatic illustration of the mechanism for sensing approach to the target and firing the boost motor.
Figure 4:
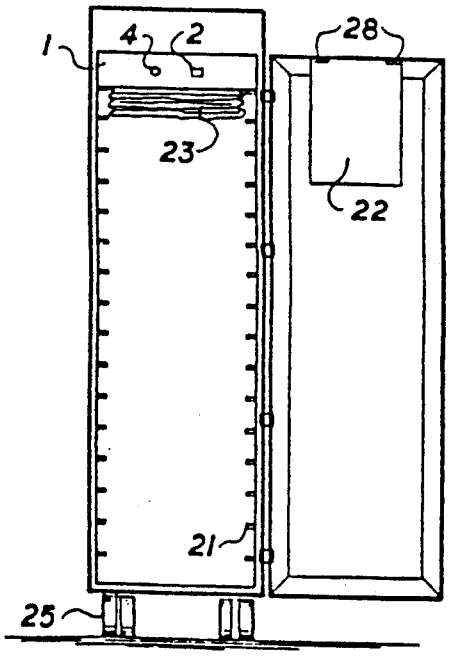
Figure 5:
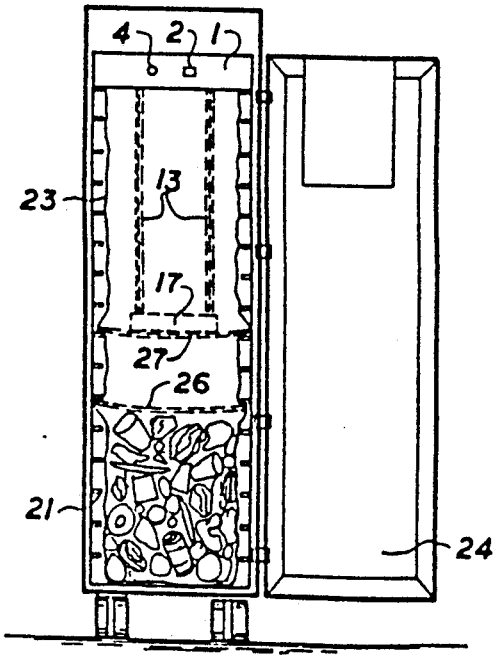

FIG. 2 of the drawings shows a light anti-armor weapon 10 according to a preferred embodiment of the present invention, which is designed to be launched and fly to a target 12 in the manner illustrated in FIG. 1.

The weapon basically comprises a generally cylindrical outer housing or casing 13 having an aerodynamically shaped forward end 14, with a solid penetrator rod 16 mounted coaxially in the casing to project up to its forward end. Rod 16 has a pointed forward end generally shaped to conform to the casing forward end. The rod is held in place by a suitable support structure 18. The casing is preferably formed in two separable front and rear casing sections 20 and 21, which are releasably secured together in a manner known in the missile field. The front section 20 houses the penetrator at its forward end and a boost motor 22 with boost propellant grain 23 at its rear end, while the rear section comprises a launch motor 24 having a propellant grain 25 and outlet nozzle 26. A battery igniter or proximity fuze 27 is associated with the boost motor 22. A suitable barrier or connecting joint 28 is provided between the front and rear sections. This will prevent early firing of the igniter.

A suitable proximity or standoff sensor 30 is mounted at the forward end of the casing to detect approach of the weapon to the target. The sensor is preferably of a commonly known, infra-red sensor type employing reflected infra-red radiation for detecting approach and distance from a target. Such sensors are manufactured by Motorola, for example. The sensor is connected to suitable electronics 32 within the casing, which interprets the sensor output signals in a manner known in the field to produce an output control signal when the weapon is a desired distance from the target 12, as indicated schematically in FIG. 3. The output control signal is suitably connected to the boost motor igniter or fuse 27 to ignite the boost motor at the desired distance from the target.

FIG. 1 illustrates the use of the weapon in defense against armored vehicles such as tanks. The weapon is illustrated in FIG. 1 as launched by a foot soldier 34 from a shoulder held launch tube 36. However, it will be understood that the launch tube or firing barrel may alternatively be mounted on a pedestal, either on the ground or on a vehicle such as a jeep. It may also be mounted for firing from other surface or aircraft vehicles. Several weapons or projectiles 10 may be mounted for firing from successive barrels of a multiple barrel cannon or the like. The launch motor 24 is preferably a rocket motor of the type generally used in firing weapons such as the Viper or Viper Variant, which, when fired, will launch the weapon from the launch tube at a safe, subsonic speed of the order of 900 ft/sec or 300 m/sec.

The weapon will then fly at the subsonic speed towards the target. When the weapon is a predetermined distance from the target, suitably up to approximately 6 to 8 feet as detected by the standoff sensor, a control signal will be produced by the sensor electronics 32 to actuate the boost motor igniter to fire the boost motor 22. The boost motor may be any suitable motor capable of accelerating the weapon up to "hypersonic" speeds of over 3 Km/sec, and is preferably a high thrust, very rapid burning rocket motor capable of producing this increase in speed in a relatively short distance. These speeds are of the order sufficient for penetrator-type weapons to penetrate and damage or destroy an armored target.

The launch motor 24 will be ejected by the ignition of the high thrust boost motor, and the remainder of the weapon will accelerate to fly the remaining distance to the target at the desired high velocity required for the penetrator to function. Since the weapon is not accelerated until it is fairly close to the target, the risk of missing the target is substantially reduced or avoided. The penetrator rod will be of a suitable dense metal such as tungsten or the like or a composite device. This will result in a weapon carry weight as low as 10 pounds, with an effective range between 500 and 750 meters. On arrival at the target, the hypervelocity penetrator rod will pierce the armor of the target, damaging and potentially disabling it.

The weapon can be fired from a launch tube or firing barrel equivalent to that used in existing anti-armor weapon systems, although the tube may be made longer to accommodate additional length of the penetrator rod 16, or boost motor 22. This weapon is capable of defeating armor types which are not normally penetrated by the standard, explosive charge based weapons. The weapon relies solely on its kinetic energy to damage the target, and thus does not require any explosive charge, so that it is much safer for the personnel either firing the weapon or driving a vehicle on which the firing barrel is mounted. Since the launcher is subjected only to the forces involved in firing the weapon at subsonic speed, it is less complicated and bulky that launchers used to fire other kinetic energy weapons at hypersonic velocities. The weapon can therefore be launched from any desired location, including shoulder held launchers, vehicle mounted launchers, and aircraft mounted launchers.

Although a preferred embodiment of the invention has been described above by way of example only, it will be understood by those skilled in the field that modifications may be made to the disclosed embodiment without departing from the scope of the invention, which is defined by the appended claims.

I claim:

1. A light anti-armor weapon, comprising:

a pair of separable front and rear units releasably secured together in axial alignment;

the front unit comprising an outer casing carrying a non-explosive, armor-penetrating device at its forward end and a boost propulsion means at its rear end for accelerating the front unit including the outer casing and armor penetrating device to a predetermined hypersonic velocity, and an igniter for firing the boost propulsion means;

the rear unit comprising an outer casing releasably secured at its forward end to the rear end of the front unit outer casing and containing primary propulsion means including propellant for launching both units from a launch tube and propelling said units at subsonic speed towards a target;

sensor means for detecting when the weapon is a predetermined distance from the target and subsequently actuating the igniter to fire the boost propulsion means; and means for separating the two units on actuation of said igniter to separate said entire rear unit including said outer casing and primary propulsion means form said front unit and propel said front unit alone at hypersonic velocity to impact the target.

2. The weapon as claimed in claim 1, wherein the penetrating device comprises a solid rod of dense metal.

3. The weapon as claimed in claim 1, wherein the penetrating device comprises a solid rod of metal composite material.

4. The weapon as claimed in claim 1, wherein the launch propulsion means comprises a rocket motor for firing the weapon at a velocity between 250 to 350 m/sec.

5. The weapon as claimed in claim 1, wherein the boost propulsion means comprises a high thrust rocket motor for accelerating the weapon to a hypersonic velocity.

6. The weapon as claimed in claim 5, wherein the hypersonic velocity is between 3 and 4 Km/sec.

7. The weapon as claimed in claim 1, wherein the sensor means comprises means for producing the control signal when the weapon is at a distance of between 6 to 8 feet from the target.

8. The weapon as claimed in claim 1, wherein the sensor means comprises means for detecting when the weapon is around 6 to 8 feet from the target, the launch propulsion means comprising means for propelling the weapon at subsonic speed up to that position.

* * * * *